US006146110A

United States Patent [19]

Higashihara et al.

[11] Patent Number: 6,146,110

[45] Date of Patent: Nov. 14, 2000

[54] SWASH PLATE TYPE COMPRESSOR

[75] Inventors: Shinichiro Higashihara; Toshikatsu Miyaji, both of Tochigi, Japan

[73] Assignee: Calsonic Corporation, Tokyo, Japan

[21] Appl. No.: 09/175,418

[22] Filed: Oct. 20, 1998

[30] Foreign Application Priority Data

Oct. 21, 1997 [JP] Japan ..... 9-288761

[51] Int. Cl.[7] ..... F04B 1/12

[52] U.S. Cl. ..... 417/269; 417/222 R; 29/888.042

[58] Field of Search ..... 417/222 R, 269, 417/222.2; 29/888.042, 156.4 WL; 92/12.2

[56] References Cited

U.S. PATENT DOCUMENTS

| | | | |
|---|---|---|---|
| 3,864,801 | 2/1975 | Nakayama et al. | 29/156.4 |
| 3,930,758 | 1/1976 | Park | 417/269 |
| 4,347,046 | 8/1982 | Brucken et al. | 417/269 |
| 4,360,321 | 11/1982 | Copp, Jr. et al. | 417/269 |
| 4,534,710 | 8/1985 | Takeshi et al. | 417/269 |
| 4,704,073 | 11/1987 | Nomura et al. | 417/269 |
| 4,834,336 | 5/1989 | Shimazaki et al. | 248/666 |
| 5,032,060 | 7/1991 | Kobayashi et al. | 417/222 R |
| 5,518,374 | 5/1996 | Ota et al. | 417/222.2 |
| 5,547,346 | 8/1996 | Kanzaki et al. | 417/222.2 |
| 5,562,425 | 10/1996 | Kimura et al. | 417/269 |
| 5,607,287 | 3/1997 | Ikeda et al. | 417/269 |
| 5,624,240 | 4/1997 | Kawaguchi et al. | 417/222.22 |
| 5,706,716 | 1/1998 | Umemura | 92/165 |
| 5,749,712 | 5/1998 | Umemura | 417/269 |
| 5,941,157 | 8/1999 | Tokumasu | 92/12.2 |
| 5,960,542 | 10/1999 | Unemura et al. | 29/888.042 |

FOREIGN PATENT DOCUMENTS

| | | |
|---|---|---|
| 5-195949 | 8/1993 | Japan . |
| 6-101640 | 4/1994 | Japan . |
| 7-103138 | 4/1995 | Japan . |
| 8-61231 | 3/1996 | Japan . |

*Primary Examiner*—Teresa Walberg
*Assistant Examiner*—Leonid Fastovsky
*Attorney, Agent, or Firm*—Foley & Lardner

[57] ABSTRACT

A swash plate type compressor for refrigerant in a refrigeration cycle of an air conditioning system for an automotive vehicle. The compressor comprises a cylinder block having a plurality of cylinder bores. A plurality of pistons are provided to be respectively fitted in the cylinder bores, each piston making a linear movement under action of a swash plate which is rotatable with a drive shaft. Additionally, a rear housing is provided having a refrigerant suction chamber and a refrigerant discharge chamber. The rear housing has first and second end sections, in which the first end section is connected through a valve plate to an end section of the cylinder block. The refrigerant suction chamber and the refrigerant discharge chamber are connectable with the cylinder bores of the cylinder block through holes formed in the valve plate. The rear housing includes a base section connected through the valve plate to the cylinder block and being formed thereinside with a first part of the refrigerant discharge chamber. A bulged section is formed integral with the base section and projecting in a direction opposite to the cylinder block. The bulged section has an inside depression which forms a second part of the refrigerant discharge chamber. The bulged section has a linear groove formed at a surface forming part of the second end section of the rear housing and depressed in a direction of the first end section of the rear housing. Bracket walls are formed integral with the bulged section to close opposite end sections of the linear groove.

7 Claims, 2 Drawing Sheets

SWASH PLATE TYPE COMPRESSOR

BACKGROUND OF THE INVENTION

1. Field of the Invention

This invention relates to improvements in a swash plate type compressor for refrigerant, disposed in a refrigeration cycle, for example, of an air conditioning system of an automotive vehicle.

2. Description of the Prior Art

Swash plate type compressors have been well known and put into practical use, for example, in order to pressurize refrigerant in an air conditioning system of an automotive vehicle. A typical example of such a swash plate type compressor is disclosed in Japanese Patent Provisional Publication No. 5-195949, in which the compressor is provided at its rear housing with two refrigerant discharge chambers for the purpose of increasing the volume of a refrigerant discharge chamber. This is advantageous from the viewpoint of suppressing pulsation of refrigerant discharged from the compressor thereby improving stillness of the compressor.

Such a compressor to be used in the automotive vehicle has been required to be small-sized in locational layout since it is mounted together with other engine accessories in an engine compartment. However, providing a plurality of the refrigerant discharge chambers in the rear housing as discussed above unavoidably leads to prolongation of the whole length of the compressor. Additionally, the housing of such a compressor is usually provided with an installation bracket which radially outwardly projects in the form of a projection piece for the purpose of installing the compressor to an engine block. This unavoidably increases the radial size of the compressor.

In view of this, it has been proposed to provide the installation bracket in the form of a projection piece to an end wall of the rear housing. However, this further increases the whole length of the compressor of the type having a plurality of the refrigerant discharge chambers in the rear housing as discussed above, which is contrary to the requirement for making the compressor small-sized.

BRIEF SUMMARY OF THE INVENTION

It is an object of the present invention to provide an improved swash plate type compressor which can effectively overcome drawbacks encountered in conventional swash type compressors.

Another object of the present invention is to provide an improved swash plate type compressor which is realized to be small-sized while reducing noise due to pulsation of refrigerant.

A further object of the present invention is to provide an improved swash plate type compressor in which the volume of a refrigerant discharge chamber is increased to reduce noise due to pulsation of refrigerant, without enlarging the whole length of the compressor.

A still further object of the present invention is to provide an improved swash plate type compressor in which brackets for the purpose of installation of the compressor are provided to a rear housing without increasing the whole length of the compressor.

A swash plate type compressor of the present invention is for refrigerant and comprises a cylinder block having a plurality of cylinder bores. A plurality of pistons are provided to be respectively fitted in the cylinder bores, each piston making a linear movement under action of a swash plate which is rotatable with a drive shaft. Additionally, a rear housing is provided having a refrigerant suction chamber and a refrigerant discharge chamber. The rear housing has first and second end sections, in which the first end section is connected through a valve plate to an end section of the cylinder block. The refrigerant suction chamber and the refrigerant discharge chamber are connectable with the cylinder bores of the cylinder block through holes formed in the valve plate. The rear housing includes a base section connected through the valve plate to the cylinder block and being formed thereinside with a first part of the refrigerant discharge chamber. A bulged section is formed integral with the base section and projecting in a direction opposite to the cylinder block. The bulged section has an inside depression which forms a second part of the refrigerant discharge chamber. The bulged section has a linear groove formed at a surface forming part of the second end section of the rear housing and depressed in a direction of the first end section of the rear housing. Bracket walls are formed integral with the bulged section to close opposite end sections of the linear groove.

With the above-arranged swash plate type compressor, the bulged section is formed at the end wall of the rear housing so as to project rearward and located corresponding to the refrigerant discharge chamber. Accordingly, the volume of the refrigerant discharge chamber is enlarged thereby suppressing pulsation of refrigerant to be discharged from the compressor thus improving stillness of the compressor. This prevents such pulsation from being transmitted to the inside of a passenger compartment via piping of a refrigeration cycle of the air conditioning system, thus improving stillness inside the passenger compartment.

Additionally, the bulged section is formed with the linear groove and integrally provided with the bracket walls in such a manner as to close the opposite end sections of the linear groove. Accordingly, an installation bolt is located in the linear groove, in which the bolt is fixed to the rear housing by the bracket walls. The rear housing is fixed to an engine block. Further, the bracket walls are within a projecting range of the bulged section. In other words, the bulged section is formed or molded having a predetermined projection height (rearward projection distance) corresponding to that of the bracket walls so that the volume of the refrigerant discharge chamber can be enlarged. Thus, it is achieved to enlarge the volume of the refrigerant discharge chamber and to provide brackets (or the bracket walls) to the end wall of the rear housing, without changing the whole length of the compressor. This realizes making the compressor small-sized.

Furthermore, the bracket walls are formed integral with the bulged section so as to serve as closing walls, and therefore stiffness of the bracket walls is higher as compared with conventional brackets which are formed projecting as projection pieces. Thus, such a configuration can improve installation stiffness for the compressor.

DETAILED DESCRIPTION OF THE INVENTION

Figure 1:
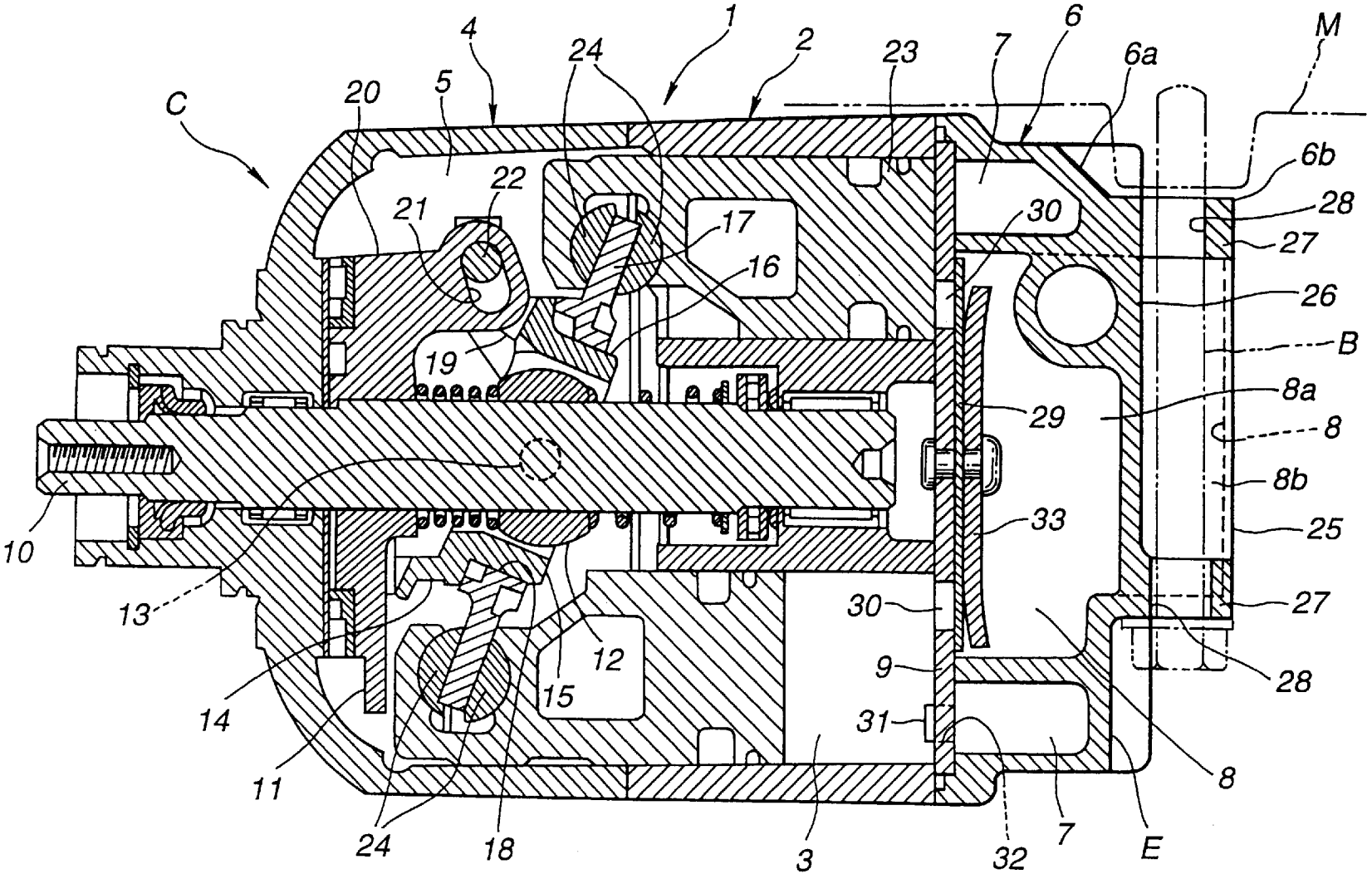
FIG. 1 is a vertical sectional view of an embodiment of a swash plate type compressor according to the present invention.
Figure 2:
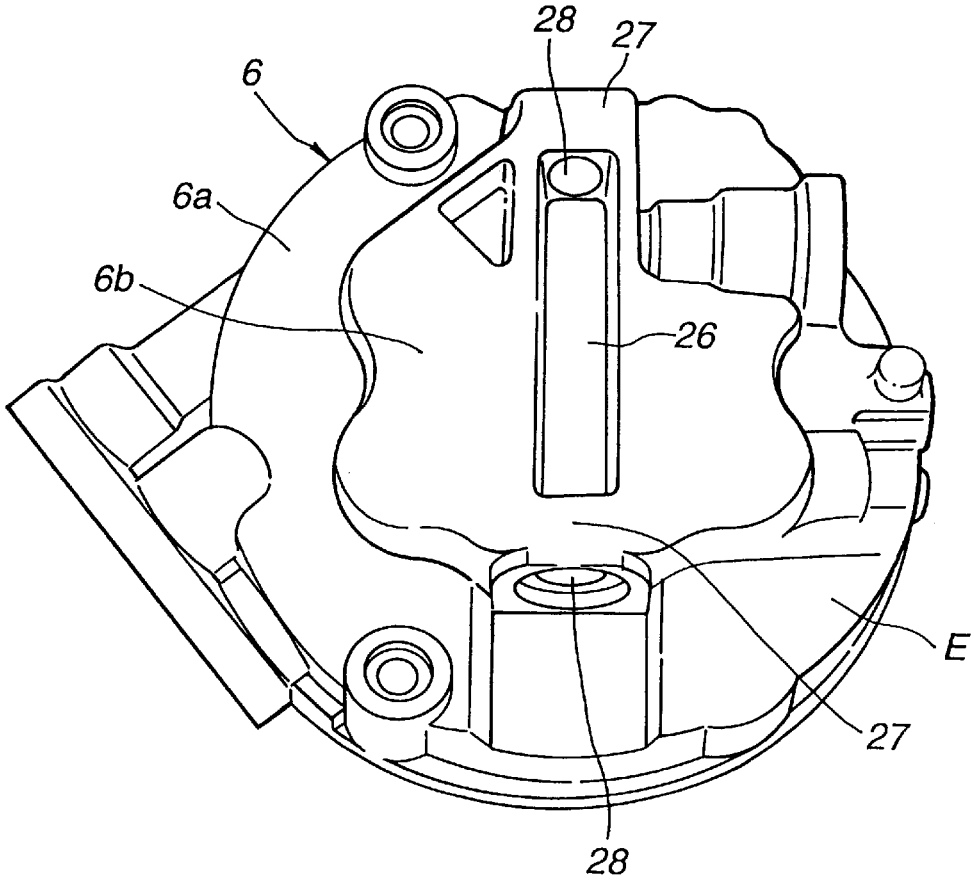
FIG. 2 is a perspective view of a rear housing of the swash plate type compressor of FIG. 1, as viewed from the rear side.
Figure 3:
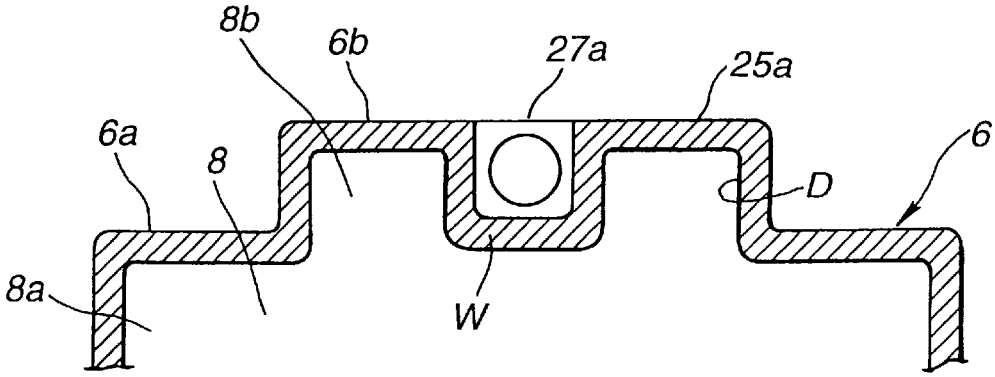
FIG. 3 is a fragmentary sectional view of an end wall of the rear housing of FIG. 2.

Referring now to FIGS. 1 to 3, a first embodiment of a swash plate type compressor according to the present invention is illustrated by the reference character C. The swash type compressor C of this embodiment is a variable displacement compressor and used for pressurizing refrigerant in an air conditioning system (not shown) of an automotive vehicle. The compressor C comprises a compressor housing 1 which includes a cylinder block 2. The cylinder block 2 is formed with a plurality of cylinder bores 3. A front housing 4 is disposed in front of the cylinder block 2 and fixedly connected to the cylinder block 2 to define thereinside a crank chamber 5. A rear housing 6 is disposed behind the cylinder block 2 and fixedly connected to the cylinder block 2 through a valve plate 9. The rear housing 6 is formed with a refrigerant suction chamber 7 and a refrigerant discharge chamber 8. The refrigerant discharge chamber 8 is located at the diametrically central section of the rear housing, while the refrigerant suction chamber 7 is located at the diametrically outer peripheral section of the refrigerant discharge chamber 8.

A drive shaft 10 is disposed to axially extend through the front housing 4 and the cylinder block 3. A drive plate 11 is fixedly mounted on the drive shaft 10 and located in the crank chamber 5. A sleeve 12 is slidably mounted on the drive shaft 10. A journal 14 is swingably connected through pins 13 to the sleeve 12. The journal 14 has a boss section 15 which is formed at its outer peripheral surface with an external thread portion 16. A generally annular disc-shaped swash plate 17 is fixedly and coaxially mounted on the boss section 15 of the journal 14 in such a manner that an internal thread 18 of the swash plate 17 is engaged with the external thread portion 16 of the journal 14. The journal 14 has a hinge arm 19 which is movably connected to a hinge arm 20 of the drive plate 11 in such a manner that a pin 22 of the hinge arm 19 is slidably disposed within an elongate hole 21 of the hinge arm 20, so that swingable movement of the journal 14 is restricted under the action of the elongate hole 21.

A piston 23 is movably disposed inside each cylinder bore 3. Each piston 23 is connected to the swash plate 17 through a pair of shoes 24 which are located respectively on the opposite sides of swash plate 17. The swash plate 17 is inclinable relative to an imaginary plane (not shown) to which the axis of the drive shaft 10 is perpendicular, thereby forming an inclination angle. The inclination angle of the swash plate 17 is changed by a pressure within the crank chamber 5 which pressure is adjusted in accordance with a pressure within the refrigerant suction chamber 7 under the action of a pressure control valve mechanism (not shown). Such change in inclination angle of the swash plate 17 changes the stroke of each piston 23 thereby altering the amount of refrigerant discharged from the compressor C.

The valve plate 9 is formed with discharge holes 30 and suction holes 32 through which refrigerant flows in and out of the cylinder bores 3. The discharge holes 30 are closable with a lead valve 29. The lead valve 29 is restricted in its movement by a retainer 33. The suction holes 32 are closable with lead valves 31.

The basic construction and operation of the swash plate type compressor C are known as disclosed in U.S. Pat. No. 5,706,716 entitled "Variable Displacement Swash Plate Type Compressor", and U.S. Pat. No. 5,749,712 entitled "Variable Displacement Swash Plate Type Compressor" which are hereby incorporated by reference.

In this embodiment, the rear housing 6 includes a base section **6*a* which is formed thereinside with the refrigerant suction chamber 7 and a main part 8*a* of the refrigerant discharge chamber 8. The refrigerant suction chamber 7 is formed at the generally diametrically peripheral section of the rear housing base section 6*a* and fluidly connectable through the suction holes 32 with the cylinder bores 3. The refrigerant discharge chamber 8 is formed at the generally diametrically central section of the rear housing base section 6*a* and fluidly connectable through the discharge holes 38 with the cylinder bores 3**.

The rear housing 6 is integrally formed at its end wall E with a bulged or projected section 25 which projects rearward or in a direction opposite to the cylinder block 2. The bulged section 25 are located at the generally diametrically central section of the end wall E of the rear housing 6 and positioned corresponding to the main part **8*a* of the refrigerant discharge chamber 8. The inside of the bulged section 25 is depressed to form an inside depression D (shown in FIG. 3) which forms an auxiliary part 8*b* of the refrigerant discharge chamber 8. The auxiliary part 8*b* is merged in the main part 8*a* to form the refrigerant discharge chamber 8**.

The bulged section 25 of the rear housing 6 is formed at its rear flat surface with a linear groove 26 which is located at the generally central section and extends diametrically. The linear groove 26 has a size sufficient to receive an installation bolt B (or a nut) as shown in phantom in FIG. 1. It will be understood that the linear groove 26 is separate and independent from the refrigerant discharge chamber 8 by a wall portion W of the rear housing 6 as shown in FIG. 3. In other words, the wall portion W is generally channel-shaped to define thereoutside the linear groove 26 and forms part of the end wall E of the rear housing 6, so that the linear groove 26 is completely isolated from the refrigerant discharge chamber 8.

The opposite end sections of the linear groove 26 are closed respectively with bracket walls 27, 27 each of which is formed with a bolt insertion hole 28 through which the bolt is insertable as indicated in phantom in FIG. 1. The bracket walls 27, 27 are formed integral with the bulged section 25. In this connection, the bulged section 25 projects rearward by a distance corresponding to a rearward projection distance (height) of the bracket walls 27, 27 which distance is required for bolt-nut connection through which the rear housing 6 is fixed to an engine block M of the vehicle. In this embodiment, the rear surface **27*a* of each bracket wall 27 is flush with the rear surface 25*a* of the bulged section 25 as shown in FIG. 3**.

With the above-arranged compressor C, the bulged section 25 is formed at the end wall E of the rear housing 6 so as to project rearward and be located corresponding to the refrigerant discharge chamber main part **8*a*. Accordingly, the volume of the refrigerant discharge chamber 8** is enlarged thereby suppressing pulsation of refrigerant to be discharged from the compressor C thus improving stillness of the compressor C. This prevents such pulsation from being transmitted to the inside of a passenger compartment via piping of a refrigeration cycle of the air conditioning system, thus improving also stillness inside the passenger compartment.

Additionally, the bulged section 25 is formed with the linear groove 26 and integrally provided with the bracket walls 27, 27 in such a manner as to close the opposite end sections of the linear groove 26. Accordingly, the installation bolt B is located in the linear groove 26, in which the bolt B is fixed to the rear housing 6 by the bracket walls 27, 27. The rear housing 6 is fixed to the engine block M as shown in phantom in FIG. 1.

Further, the bracket walls 27, 27 are within a projecting range of the bulged section 25. In other words, the bulged section 25 is formed or molded having a predetermined projection height (rearward projection distance) corresponding to that of the bracket walls 27, 27 so that the volume of the refrigerant discharge chamber 8 can be enlarged. Thus, it is achieved to enlarge the volume of the refrigerant discharge chamber 8 and to provide brackets (or the bracket walls 27, 27) to the end wall E of the rear housing 6, without changing the whole length of the compressor C. This realizes making the compressor C small-sized.

Furthermore, the bracket walls 27, 27 are formed integral with the bulged section 25 so as to serve as closing walls, and therefore stiffness of the bracket walls 27, 27 is high as compared with conventional brackets (not shown) which are formed projecting as projection pieces Thus, such a configuration can improve installation stiffness for the compressor C.

Particularly in this embodiment, the bulged section 25 is formed at the diametrically central section of the end wall E of the rear housing 6 and located corresponding to the refrigeration discharge chamber main part 8*a* located at the diametrically central section of the rear housing base section 6*a*. Accordingly, the diametrical dimension of the bulged section 25 can be reduced as small as possible thereby to contribute to making the compressor C light in weight, while the groove 26 is formed diametrically extending so that the bracket walls 27, 27 are diametrically separate from each other. As a result, the compressor C can be installed to the engine block M through the bracket walls 27, 27 along a line which passes through the center axis of the compressor C, and therefore installation stability of the compressor C can be improved.

While the bulged section 25 has been shown and described as being formed bulged at the section corresponding the centrally located refrigerant discharge chamber main part 8*a* in the rear housing base section 6*a* in this embodiment, it will be understood that the bulged section 25 may be formed by wholly projecting rearward the end wall E of the rear housing 6 including a section corresponding to the refrigerant suction chamber 7.

Although only the variable displacement type and swash plate type compressor has been shown and described, it will be appreciated that the principle of the present invention may be applicable to a swash plate type compressor of the structure wherein an inclination angle of the swash plate is constant.

What is claimed is:

1. A swash plate type compressor for refrigerant, comprising:

a cylinder block having a plurality of cylinder bores;

a plurality of pistons each piston being fitted in one of said cylinder bores, each piston moving linearly in response to motion of a swash plate which rotates with a drive shaft; and a rear housing having a refrigerant suction chamber and a refrigerant discharge chamber, said rear housing having first and second end sections, the first end section being connected through a valve plate to an end section of said cylinder block, said refrigerant suction chamber and said refrigerant discharge chamber being operatively connected with said cylinder bores of said cylinder block through holes formed in said valve plate, said rear housing including a base section connected through said valve plate to said cylinder block and forming a first part of said refrigerant discharge chamber, a bulged section integrally formed with said base section and projecting in a direction opposite to said cylinder block, said bulged section having an inside depression which forms a second part of said refrigerant discharge chamber, said bulged section having a linear groove formed at a surface forming part of said second end section of said rear housing and depressed in a direction of said first end section of said rear housing, and first and second bracket walls integrally formed with said bulged section to close respectively opposite end sections of said linear groove, each of said bracket walls including a hole aligned with said linear groove.

2. A swash type compressor as claimed in claim 1, wherein each of said bracket walls is formed with a hole which is aligned with said linear groove.

3. A swash type compressor as claimed in claim 1, wherein said first part of said refrigerant discharge chamber is formed at a generally diametrically central section of said rear housing base section, said refrigerant suction chamber being formed diametrically outside of said refrigerant discharge chamber, wherein said bulged section is formed on a generally diametrically central section of said base section so as to correspond to the first part of said refrigerant discharge chamber.

4. A swash type compressor as claimed in claim 1, wherein said bulged section has a wall integral with a wall of said base section, said wall of said bulged section including a generally channel-shaped wall portion which defines thereoutside said linear groove and thereinside said refrigerant discharge chamber, said linear groove being isolated from said refrigerant discharge chamber through said channel-shaped wall portion.

5. A swash type compressor as claimed in claim 4, wherein said bracket walls are integral with said channel-shaped wall portion and located at opposite end sections of said channel-shaped wall portion so as to block the opposite end sections of said linear groove.

6. A swash plate type compressor for refrigerant, comprising:

a cylinder block having a plurality of cylinder bores;

a plurality of pistons which are respectively fitted in said cylinder bores, each piston moving linearly in response to motion of a swash plate which rotates with a drive shaft; and a rear housing having a refrigerant suction chamber and a refrigerant discharge chamber, said rear housing having first and second end sections, the first end section being connected through a valve plate to an end section of said cylinder block, said refrigerant suction chamber and said refrigerant discharge chamber operatively connected with said cylinder bores of said cylinder block through holes formed in said valve plate, said rear housing including a base section connected through said valve plate to said cylinder block and being formed thereinside with a first part of said refrigerant discharge chamber, a bulged section integrally formed with said base section and projecting in a direction opposite to said cylinder block, said bulged section having an inside depression which forms a second part of said refrigerant discharge chamber, said bulged section having a linear groove formed at a surface forming part of said second end section of said rear housing and depressed in a direction of said first end section of said rear housing, and first and second bracket walls integrally formed with said bulged section to close respectively opposite end sections of said linear groove, each of said bracket walls including a hole which is aligned with said linear groove; and a bolt for installing said swash plate type compressor to a base member, said bolt being disposed to pass through the holes of said bracket walls and positioned in said linear groove, said bolt including a bolt head located on the opposite side of said first bracket wall from said linear groove, and a tip end section located on the opposite side of said second bracket wall from said linear groove and insertable into the base member.

7. An installation arrangement comprising:

a swash plate type compressor for refrigerant, including:

a cylinder block having a plurality of cylinder bores;

a plurality of pistons which are respectively fitted in said cylinder bores, each piston moving linearly in response to motion of a swash plate which rotates with a drive shaft; and a rear housing having a refrigerant suction chamber and a refrigerant discharge chamber, said rear housing having first and second end sections, the first end section being connected through a valve plate to an end section of said cylinder block, said refrigerant suction chamber and said refrigerant discharge chamber operatively connected with said cylinder bores of said cylinder block through holes formed in said valve plate, said rear housing including a base section connected through said valve plate to said cylinder block and forming a first part of said refrigerant discharge chamber, a bulged section integral with said base section and projecting in a direction opposite to said cylinder block, said bulged section having an inside depression which forms a second part of said refrigerant discharge chamber, said bulged section having a linear groove formed at a surface forming part of said second end section of said rear housing and depressed in a direction of said first end section of said rear housing, and first and second bracket walls ingtegrally formed with said bulged section to close opposite end sections of said linear groove, each of said bracket walls being formed with a hole which is aligned with said linear groove; and a bolt for installing said swash plate type compressor to a base member, said bolt being disposed to pass through the holes of said bracket walls and said linear groove, said bolt including a bolt bead located on the opposite side of said first bracket wall from said linear groove, and a tip end section located on the opposite side of said second bracket wall from said linear groove and insertable into the base member.

* * * * *